US005165885A

United States Patent [19]

Iwahori

[11] Patent Number: 5,165,885

[45] Date of Patent: Nov. 24, 1992

[54] SAFETY MECHANISM FOR A LIGHTER

[76] Inventor: Masayuki Iwahori, 15-19, Nakada Honmachi Shizuoka-shi, Shizuoka-ken, Japan

[21] Appl. No.: 879,991

[22] Filed: May 8, 1992

[30] Foreign Application Priority Data

Oct. 17, 1991 [JP] Japan ..... 3-298467

[51] Int. Cl.[5] ..... F23D 11/36

[52] U.S. Cl. ..... 431/153; 431/276

[58] Field of Search ..... 431/153, 276, 277

[56] References Cited

U.S. PATENT DOCUMENTS 5,090,893 2/1992 Floriot ..... 431/153

FOREIGN PATENT DOCUMENTS 3501647 4/1991 Japan .

*Primary Examiner*—Carroll B. Dority

*Attorney, Agent, or Firm*—Harrison & Egbert

[57] ABSTRACT

A safety mechanism for a lighter which mechanism makes it difficult for infants or children to create a fire with the lighter. The safety mechanism is simple in construction, reliable and acceptable for the proper user of the lighter. The safety mechanism comprises a gas lever movable to and away from a gas nozzle, said gas lever being provided at a front end thereof with a nozzle lifting portion, said nozzle lifting portion being engaged with said gas nozzle when said gas lever has been moved forward, a spring disposed between said gas lever and a lighter body, said spring pushing said gas lever away from said gas nozzle, said lighter body having a lever engagement portion, said lever engagement portion engaging with said gas lever when said gas lever has been moved forward and said nozzle lifting portion thereof has been engaged with said gas nozzle, said lever engagement portion disengaging from said gas lever when said gas lever has been turned in the direction of lifting said gas nozzle. Said spring may be a leaf spring formed in one body with a lighter body component member.

2 Claims, 3 Drawing Sheets

PRIOR ART

SAFETY MECHANISM FOR A LIGHTER

BACKGROUND OF THE INVENTION (1) Field of the Invention

The present invention relates to a safety mechanism for a lighter for cigarettes, cigars, etc. More particularly, it relates to a safety mechanism for a lighter which mechanism makes it difficult for infants or children to create a fire with the lighter.

(2) Description of the Prior Art

A lighter designed to make a fire by an easy operation is desirable for the proper user of the lighter. However, such a lighter is very dangerous when it has come into the hands of infants or children who do not recognize the danger of the lighter. Such infants or children may create a fire with the lighter and get burnt or cause an accidental fire.

In view of the above, Japanese Patent Laid-Open Publication No. Hei 3-501647 (PCT/FR89/00339, WO90/00239) provides a safety mechanism which makes it difficult for infants or children to create a fire with a lighter. As shown in FIG. 7, this safety mechanism comprises a gas lever 1 (A lever for pulling up a gas emission nozzle. When the rear portion of the gas lever 1 is pushed downward, the gas emission nozzle is pulled upward thereby and emits gas.) provided in its rear side wall 2 with a horizontal opening 3 having a certain angular range, a notch 4 cut upward into one end of said opening 3, a stop lever 5 horizontally rotatably disposed under said gas lever 1, one end of said stop lever 5 protruding from said opening 3. When the stop lever 5 is in an unlocked position, which is a position under the notch 4 of said opening 3, as shown in FIG. 7 (1), the gas lever 1 is allowed to turn downward. When the stop lever 5 is in a locked position, which is any position in said opening 3 other than said unlocked position, as shown in FIG. 7 (2), the stop lever 5 does not allow the gas lever 1 to turn downward. A spiral spring (not shown) is used as a means for automatically returning the stop lever 5 from the unlocked position to the locked position. In this safety mechanism, the user of the lighter creates a fire when he has turned the stop lever 5 from the locked position to the unlocked position against the force of the spiral spring.

However, the safety mechanism described above has the disadvantages that it is complicated in construction and does not work with sufficient reliability.

BRIEF SUMMARY OF THE INVENTION

It is therefore an object of the invention to provide a safety mechanism for a lighter which mechanism has a simple construction.

It is another object of the invention to provide a safety mechanism for a lighter which mechanism has sufficient reliability of operation.

It is a further object of the invention to provide a safety mechanism for a lighter which mechanism minimizes the possibility that infants or children can create a fire with the lighter and at the same time is acceptable for the proper user of the lighter.

These and other objects have been attained by a safety mechanism for a lighter, which mechanism comprises a gas lever movable to and away from a gas nozzle, said gas lever being provided at a front end thereof with a nozzle lifting portion, said nozzle lifting portion being engaged with said gas nozzle when said gas lever has been moved forward, a spring disposed between said gas lever and a lighter body, said spring pushing said gas lever away from said gas nozzle, said lighter body having a lever engagement portion, said lever engagement portion engaging with said gas lever when said gas lever has been moved forward and said nozzle lifting portion thereof has been engaged with said gas nozzle, said lever engagement portion disengaging from said gas lever when said gas lever has been turned in the direction of lifting said gas nozzle.

Said spring may be a leaf spring formed in one body with a lighter body component member.

In the specification and claims of the present patent application, "forward" means "toward the left" in FIG. 1, "backward" meaning "toward the right" in FIG. 1, "rear" and "back" respectively meaning "right" in FIG. 1.

The operation of the safety mechanism for a lighter according to the present invention will now be described.

When the lighter is not used, the gas lever is kept in a position away from the gas nozzle by said spring and the nozzle lifting portion of the gas lever is in a state disengaged from the gas nozzle. When the gas lever is in this state, the gas nozzle does not move up even if the gas lever is turned or pushed downward and therefore it is impossible to create a fire with the lighter.

When the lighter is to be used, the gas lever is pushed forward against the force of said spring and the nozzle lifting portion of the gas lever is engaged with the gas nozzle. Then the lever engagement portion of the lighter body engages with the gas lever and keeps the gas lever in a state of being engaged with the gas nozzle. This means that the gas nozzle can be lifted by turning the gas lever. Now it is possible to create a fire by the same operation as in conventional lighters having no safety mechanism. When the gas lever is turned in the direction of lifting the gas nozzle in the ingiting operation, the lever engagement portion of the lighter body disengages from the gas lever and the gas lever is pushed away from the gas nozzle by the spring. Therefore, the nozzle lifting portion of the gas lever is disengaged from the gas nozzle and the gas lever is returned to said original state.

Thus, in the lighter having the safety mechanism of the present invention, the gas lever is usually disengaged from the gas nozzle. When the lighter is to be used, the gas lever is pushed forward with the thumb for example against the force of said spring to engage the nozzle lifting portion of the gas lever with the gas nozzle and then the igniting operation is made. When the gas lever is turned in the igniting operation, the gas lever is automatically returned to the original state. The two-step operation of pushing forward the gas lever against the force of the spring to engage the nozzle lifting portion of the gas lever with the gas nozzle and making the same igniting operation as in conventional lighters makes it difficult for infants or children to create a fire with the lighter having the safety mechanism of the present invention.

The safety mechanism for a lighter according to the present invention has a simple construction and sufficient reliability of operation. Furthermore, the safety mechanism of the present invention is acceptable for the proper user of the lighter.

DETAILED DESCRIPTION

The present invention will now be described in detail with reference to the attached drawings.

Figure 1:
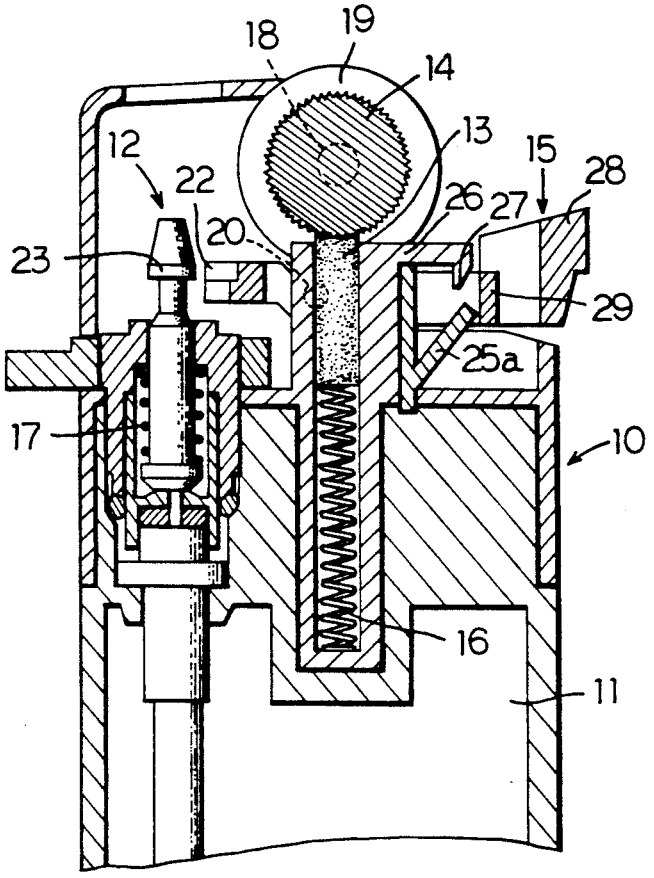
FIG. 1 is a sectional view of a lighter having an example of a safety mechanism of the present invention, in which a gas lever is disengaged from a gas nozzle.

A lighter in which a safety mechanism of the present invention is incorporated will be described first with reference to FIG. 1. This lighter comprises a lighter body 10, a fuel well 11 disposed within said lighter body 10, a gas nozzle 12 through which fuel in said fuel well 11 is emitted, a flint 13, a striker wheel 14 in contact with said flint 13, a gas lever 15 for raising said gas nozzle 12 to emit fuel, a compression spring 16 pushing said flint 13 upward against said striker wheel 14, and a return spring 17 for returning said gas nozzle 12 from a raised position. Reference numeral 18 represents a shaft of the striker wheel 14, and reference numeral 19 represents an auxiliary wheel provided on each of the two sides of said striker wheel 14. The lighter described above makes a fire if the striker wheel 14 is rotated by rotating the auxiliary wheels 19 with the thumb for example and almost simultaneously the rear portion 28 of the gas lever 15 is pushed downward with the same thumb. Then, sparks are emitted by the friction between the flint 13 and the striker wheel 14 and fuel is emitted through the gas nozzle 12 raised by the gas lever 15. Therefore, the fuel catches fire.

Figure 2:
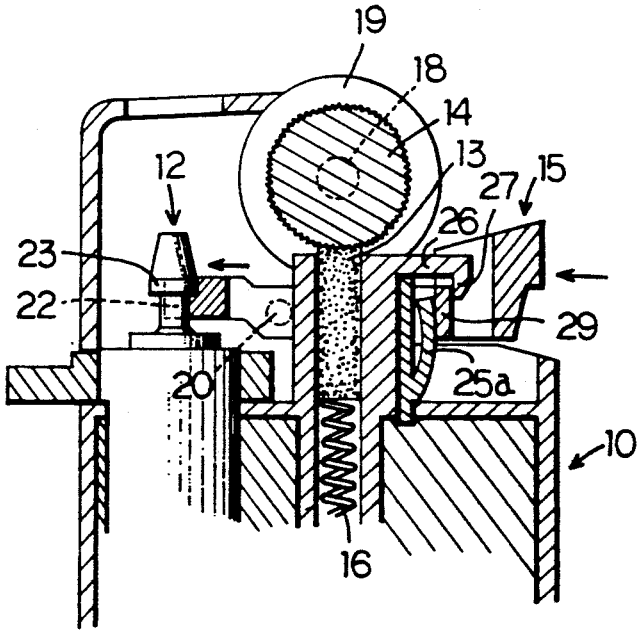
FIG. 2 is a sectional view of said lighter, in which the gas lever is engaged with the gas nozzle.
Figure 3:
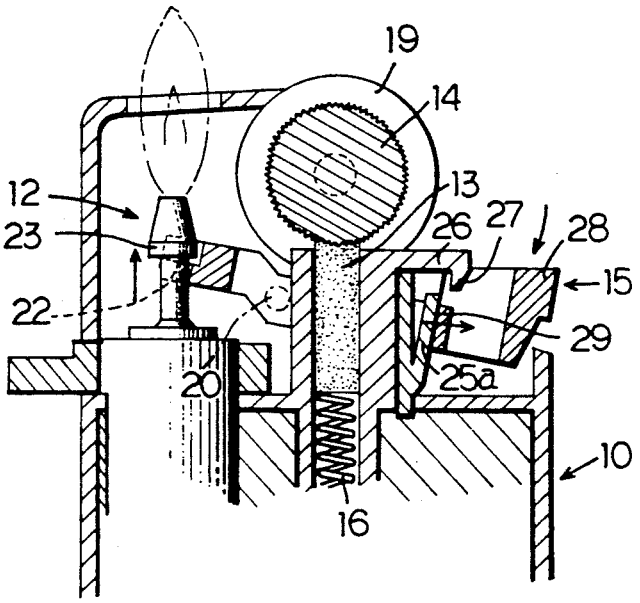
FIG. 3 is a sectional view of said lighter, in which an igniting operation is being made.
Figure 5:
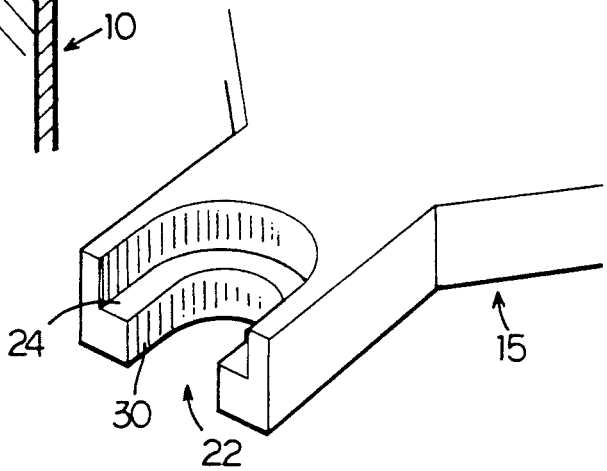
FIG. 5 is a perspective view showing a nozzle lifting portion of the gas lever.
Figure 4:
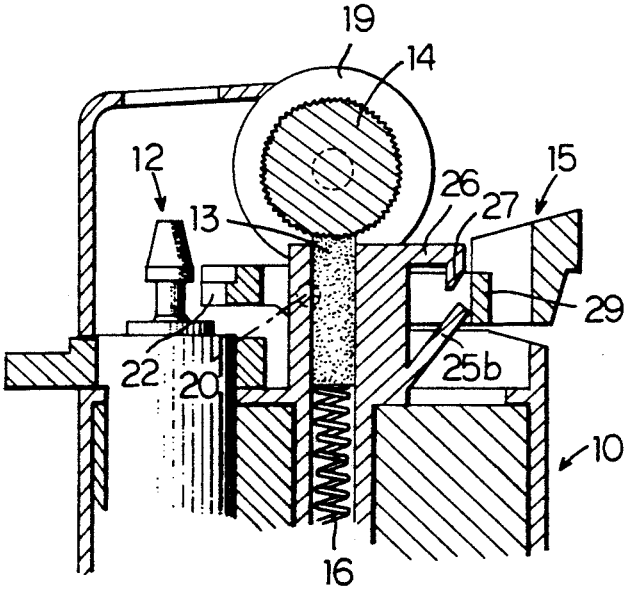
FIG. 4 is a sectional view of a lighter having another example of the safety mechanism of the present invention, in which the gas lever is disengaged from the gas nozzle.
Figure 6:
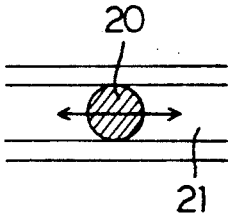
FIG. 6 is a front view showing a shaft of the gas lever and a guide thereof.
Figure 7A:
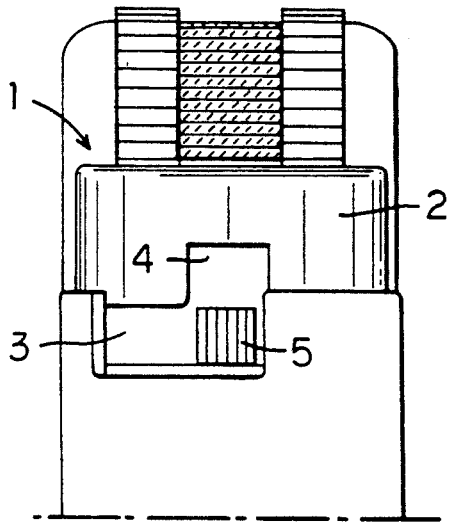
FIG. 7 (1) and FIG. 7 (2) are views showing a conventional safety mechanism.
Figure 7B:
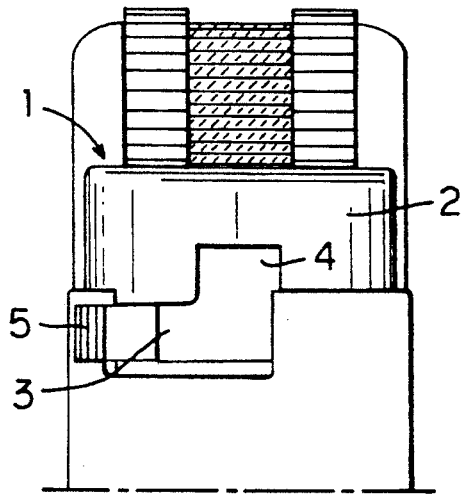
PRIOR ART FIG. 7B

Now a safety mechanism of the present invention incorporated in the lighter mentioned above will be described. Said gas lever 15, by which the gas nozzle 12 is raised, is movable to and away from the gas nozzle 12. For example, as shown in FIG. 6, a shaft 20 of the gas lever 15 is slidably received within a guide 21 disposed toward the gas nozzle 12. The gas lever 15 is provided at a front end thereof with a nozzle lifting portion 22 which is engaged with the gas nozzle 12 when the gas lever 15 has been moved forward. The nozzle lifting portion 22 may comprise, as shown in FIG. 5, a concave cut 30 in the front end of the gas lever 15, said cut 30 opening toward the front, said cut 30 being provided on the inner surface thereof with a step portion 24 engageable with the head 23 of the gas nozzle 12. A spring **25*a* is disposed between the gas lever 15 and the lighter body 10, said spring 25*a* pushing the gas lever 15 away from the gas nozzle 12. The spring 25*a* is preferably a leaf spring, but the spring 25*a* is not limited thereto. The spring 25*a* may be made of a synthetic resin or a metal. In an embodiment shown in FIGS. 1 to 3, a leaf spring 25*a*, which is a body separate from a lighter body component member 26, is attached to the lighter body component member 26. In an embodiment shown in FIG. 4, a leaf spring 25*b* is formed in one body with the lighter body component member 26. The lighter body 10 has a lever engagement portion 27. The lever engagement portion 27 engages with the gas lever 15 when the gas lever 15 has been moved forward and the nozzle lifting portion 22 thereof has been engaged with the gas nozzle 12. The lever engagement portion 27 disengages from the gas lever 15 when the gas lever 15 has been turned in the direction of lifting the gas nozzle 12. In the embodiments shown in the drawings, the lever engagement portion 27 comprises a downward hook formed in one body with the lighter body component member 26, said lever engagement portion 27 engaging with a corner 29 of the rear portion 28 of the gas lever 15**.

The relationship between the gas lever 15 and the gas nozzle 12 will be described further.

Disengaged State

This is a normal state in which the lighter is not used. The gas lever 15 is kept in a position away from the gas nozzle 12 by the spring (**25*a*, 25*b*) and the nozzle lifting portion 22 of the gas lever 15 is disengaged from the gas nozzle 12. In this state, even if the gas lever 15 is turned, the gas nozzle 12 is not raised. Therefore, it is impossible to create a fire with the lighter. See FIG. 1 and FIG. 4**.

Engaged State

This is a state in which the lighter is used. This state can be obtained by pushing forward the gas lever 15 against the force of the spring **25*a* until the nozzle lifting portion 22 of the gas lever 15 engages with the gas nozzle 12. When the nozzle lifting portion 22 of the gas lever 15 thus engages with the gas nozzle 12, the lever engagement portion 27 of the lighter body 10 engages with the corner 29 of the gas lever 15 and keeps the gas lever 15 engaged with the gas nozzle 12. In this state, it is possible to raise the gas nozzle 12 by turning the gas lever 15. This means that it is possible to create a fire with the lighter. See FIG. 2**.

Ignition

When the gas lever 15 is engaged with the gas nozzle 12 as mentioned above, the lighter makes a fire if the striker wheel 14 is rotated by rotating the auxiliary wheels 19 with the thumb for example and almost simultaneously the rear portion 28 of the gas lever 15 is pushed downward with the same thumb. This igniting operation is the same as in conventional lighters having no safety mechanism. See FIG. 3.

Automatic Return to Disengaged State

When the gas lever 15 is turned in the direction of raising the gas nozzle 12 in the igniting operation by pushing downward the rear portion 28 of the gas lever 15, the lever engagement portion 27 of the lighter body 10 disengages from the corner 29 of the gas lever 15 and the gas lever 15 is pushed away from the gas nozzle 12 by the force of the spring **25*a*. Therefore, the nozzle lifting portion 22 of the gas lever 15 disengages from the gas nozzle 12 and the gas lever 15 automatically returns to said disengaged state. See FIG. 3**.

What is claimed is:

1. A safety mechanism for a lighter, comprising a gas lever movable to and away from a gas nozzle, said gas lever being provided at a front end thereof with a nozzle lifting portion, said nozzle lifting portion being engaged with said gas nozzle when said gas lever has been moved forward, a spring disposed between said gas lever and a lighter body, said spring pushing said gas lever away from said gas nozzle, said lighter body having a lever engagement portion, said lever engagement portion engaging with said gas lever when said gas lever has been moved forward and said nozzle lifting portion thereof has been engaged with said gas nozzle, said lever engagement portion disengaging from said gas lever when said gas lever has been turned in the direction of lifting said gas nozzle.

2. A safety mechanism for a lighter as claimed in claim 1, wherein said spring is a leaf spring formed in one body with a lighter body component member.

* * * * *